US005574419A

United States Patent [19]

Droho

[11] Patent Number: 5,574,419

[45] Date of Patent: Nov. 12, 1996

[54] UNIQUE ELECTRICAL COIL WITH TAP

[75] Inventor: Joseph S. Droho, Chicago, Ill.

[73] Assignee: Philips Electronics North America Corporation

[21] Appl. No.: 226,183

[22] Filed: Apr. 11, 1994

Related U.S. Application Data

[63] Continuation-in-part of Ser. No. 806,022, Dec. 12, 1991, abandoned.

[51] Int. Cl.[6] ..... H01F 15/10

[52] U.S. Cl. ..... 336/192; 29/605

[58] Field of Search ..... 336/192; 310/71; 29/603, 605

[56] References Cited

U.S. PATENT DOCUMENTS

| | | | |
|---|---|---|---|
| 1,723,261 | 8/1929 | Varley | 336/192 |
| 2,122,894 | 7/1938 | Sager | 336/192 |
| 2,166,841 | 7/1939 | Helgason et al. | 336/192 |
| 2,404,185 | 7/1946 | Mann | 336/192 |
| 3,368,176 | 2/1968 | Rechel | 336/192 |
| 3,925,885 | 12/1975 | Smith | 29/605 |
| 4,808,959 | 2/1989 | Weissman | 336/192 |
| 4,977,666 | 12/1990 | Suzuki | 29/603 |

FOREIGN PATENT DOCUMENTS

| | | | |
|---|---|---|---|
| 1514452 | 10/1969 | Germany | 336/192 |
| 58-110 | 1/1983 | Japan | 336/192 |
| 628548 | 10/1978 | U.S.S.R. | 336/192 |

*Primary Examiner*—Thomas J. Kozma
*Attorney, Agent, or Firm*—Robert J. Kraus

[57] ABSTRACT

A method for bringing a predetermined turn of a coil located inside the width of the coil and beneath at least one layer of the coil and a coil made by such method.

5 Claims, 4 Drawing Sheets

UNIQUE ELECTRICAL COIL WITH TAP

This is a continuation-in-part under C.F.R. 1.53 of application Ser. No. 07/806,022, filed Dec. 12, 1991, now abandoned.

BACKGROUND OF THE INVENTION

The present invention relates generally to an electrical coil, and more particularly, to the construction and method for tapping of a winding within a multilayer coil.

In the past when it was desirable to gain access to a particular turn in a coil, that turn was forced to an edge position of the coil. Usually this was done by changing the turns per layer. This made the coil taller since the overall turns must remain the same in order for the coil to function for its designed task.

Conventional precision wound coils are wound so that every coil turn in every coil layer following the first layer nests (i.e. is positioned so as to rest) within a groove formed between adjacent coils of the previous layer. Tapping of a turn without disturbing the intricate matrix pattern of windings forming the precision wound coil is quite difficult and often results in anomalies in the matrix pattern.

SUMMARY OF THE INVENTION

It is therefore an object of this invention to permit access to any one of the turns of a precision wound coil notwithstanding that particular turn may be at a location inside the width of the coil and underneath at least one of the layers of the coil.

It is another object of the invention to dress out (i.e. tap) a turn of the precision wound coil without disturbing the matrix pattern of windings forming the precis wound coil.

One of the advantages of the invention is that it enables the manufacture of precision wound coils with multiple voltage taps.

A feature of the invention is that it provides a standard size coil which is suitable for use with a variety of voltages.

In carrying out the invention there is provided a precision wound electrical coil with a width which includes a number of turns of wire next to one another. The coil also has a build which includes a number of layers of turns of wire on top of one another. The coil has a voltage tap at a location inside its width and beneath at least one of its layers.

In further carrying out the invention there is provided a method of manufacturing a precision wound electrical coil. The method includes winding a number of turns of wire into a predetermined width and a predetermined number of layers. The winding is stopped at a predetermined turn in a prescribed layer. The predetermined turn is elongated until it is beyond the length of other turns in the predetermined layer. The winding is then restarted until at least one layer of turn covers the elongated turn and other turns in the predetermined layer.

Further features and advantages of the invention will be apparent from the following detailed description of the preferred embodiment when taken in conjunction with the accompanying drawings.

BRIEF DESCRIPTION OF THE DRAWINGS

The present invention is illustrated by way of example and not limited in the figures of the accompanying drawings in which like reference numerals indicate similar elements and in which.

DETAILED DESCRIPTION OF THE PREFERRED EMBODIMENT

Figure 1:
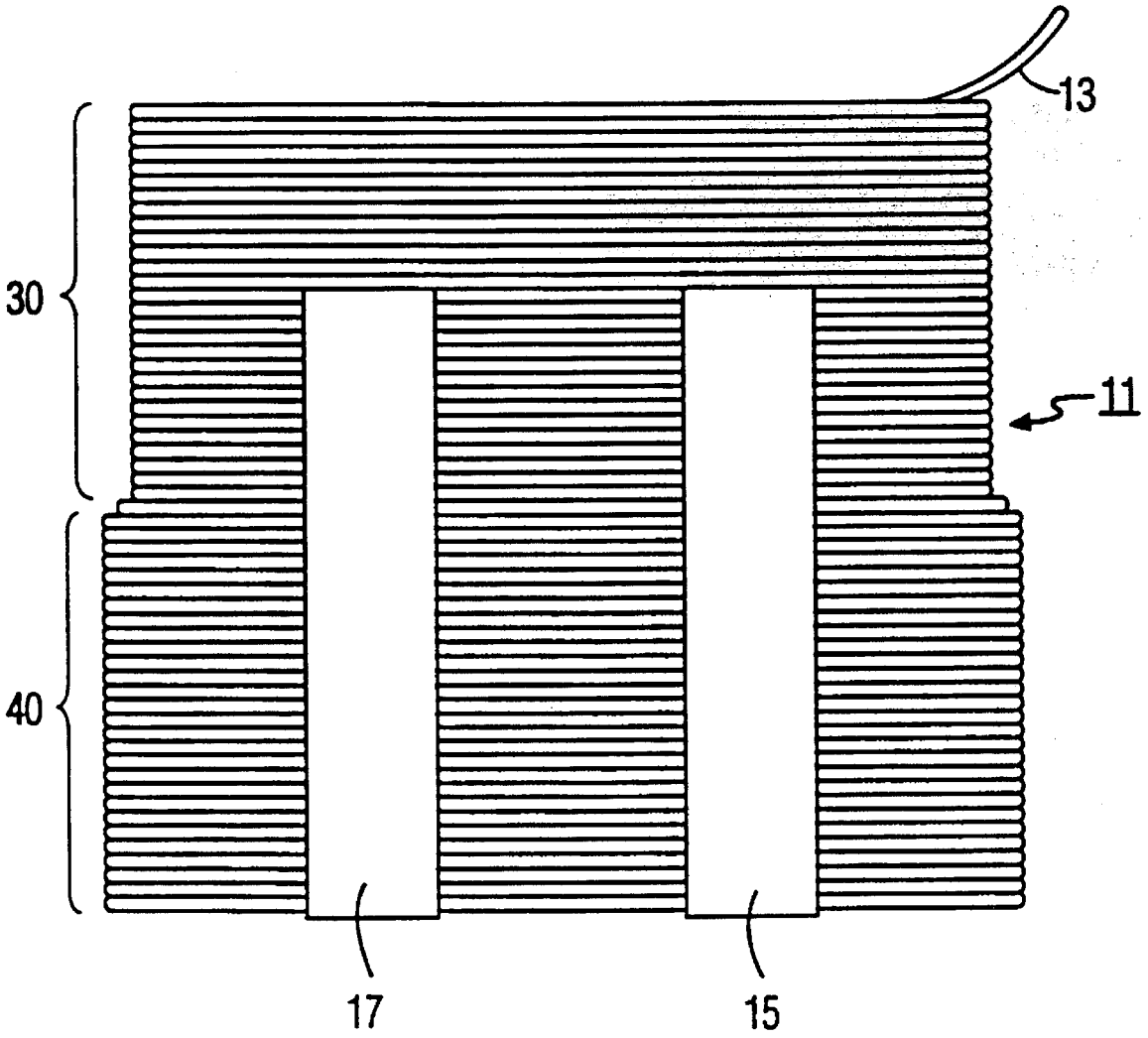
FIG. 1 shows an electrical coil being made in accordance with the invention at a first interim stage of manufacture.

As shown in FIG. 1, a precision coil 11 in a first interim stage of manufacture includes a wire 13 which is precision wound around a bobbin-like form (not shown) until at least a first layer 30 is formed. It is to be understood that one or more layers can be formed by winding wire 13 around the bobbin prior to forming layer 30.

A partially wound layer 40 is then wound from bottom to top and from right to left as shown in FIG. 1. Winding of layer 40 is temporarily halted at that turn in layer 40 which will be directly below the turn to be tapped (i.e. the turn which will be brought out of coil 11). A pair of strips 15 and 17, preferably having an adhesive backing, are then placed on coil 11 so that each tape is in contact with both the partially wound layer 40 and layer 30. Strips 15 and 17 are typically made from, but not limited to, polyester material. The adhesive backing on each strip maintains each strip on coil 11 as winding of coil 11 proceeds. Strips 15 and 17 are laid onto coil 11 so as to be substantially parallel to each other at a predetermined distance from each other (i.e. spaced apart).

Figure 2:
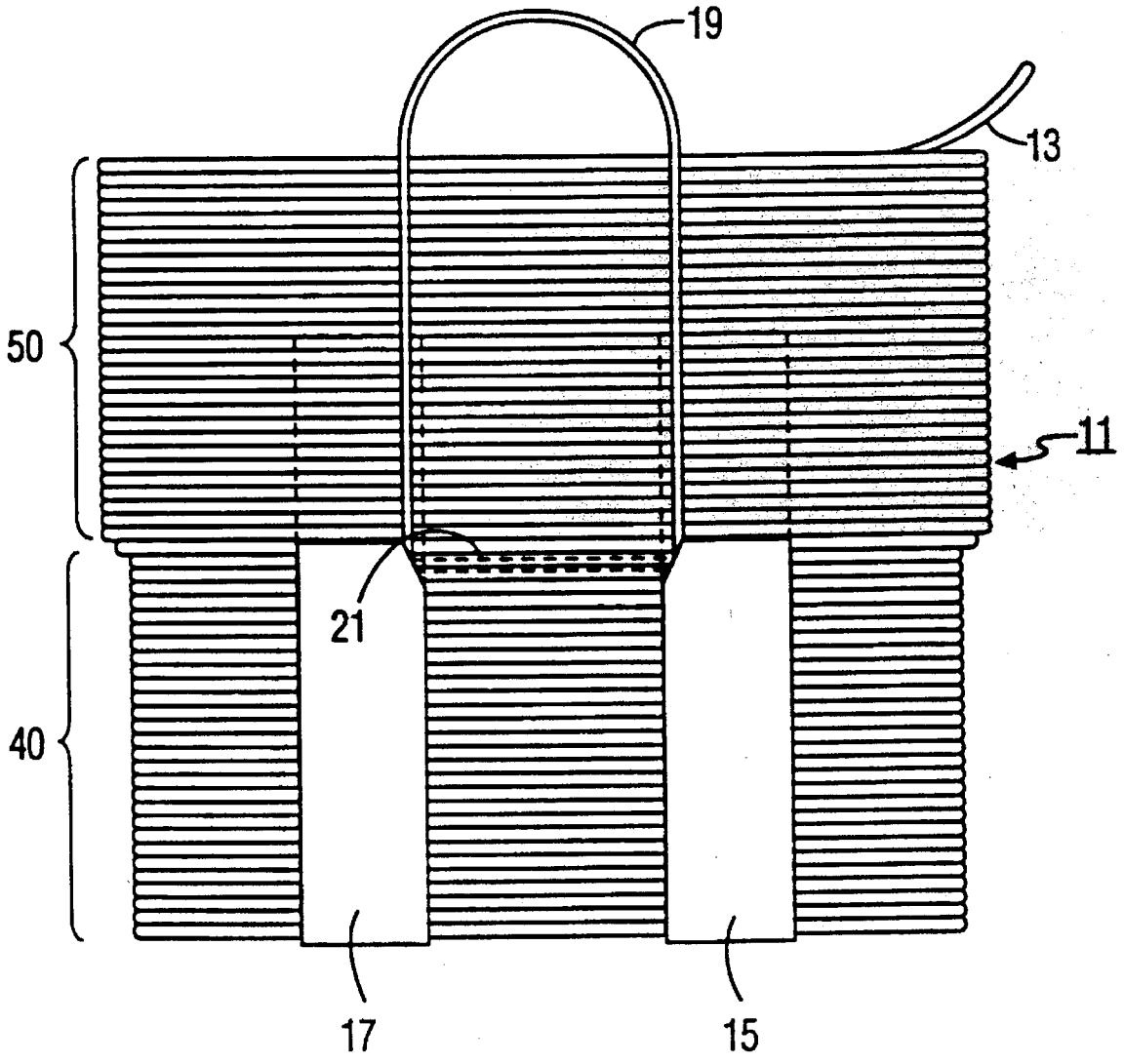
FIG. 2 shows the coil of FIG. 1 at a second interim stage, subsequent to the first stage of manufacture.

Winding of turns to form a fully wound layer 40 results in covering and thereby securing a first portion of each strip to coil 11 as shown in FIG. 2. More particularly, each strip is secured between layer 40 and layer 30.

Winding of turns continues to form a partially wound layer 50 which includes a portion of at least one tapped turn (i.e. the turn to be tapped). Strip 15 is now temporarily lifted from contact with layer 40 until the tapped turn has been wound thereunder. Strip 15 is then repositioned to once again be in contact with layer 40.

A loop 19 formed from the tapped turn between strip 15 and strip 17 is now formed by redirecting the tapped turn in a direction substantially perpendicularly to the direction in which the non-tapped turns of layer 50 are wound.

Figure 3:
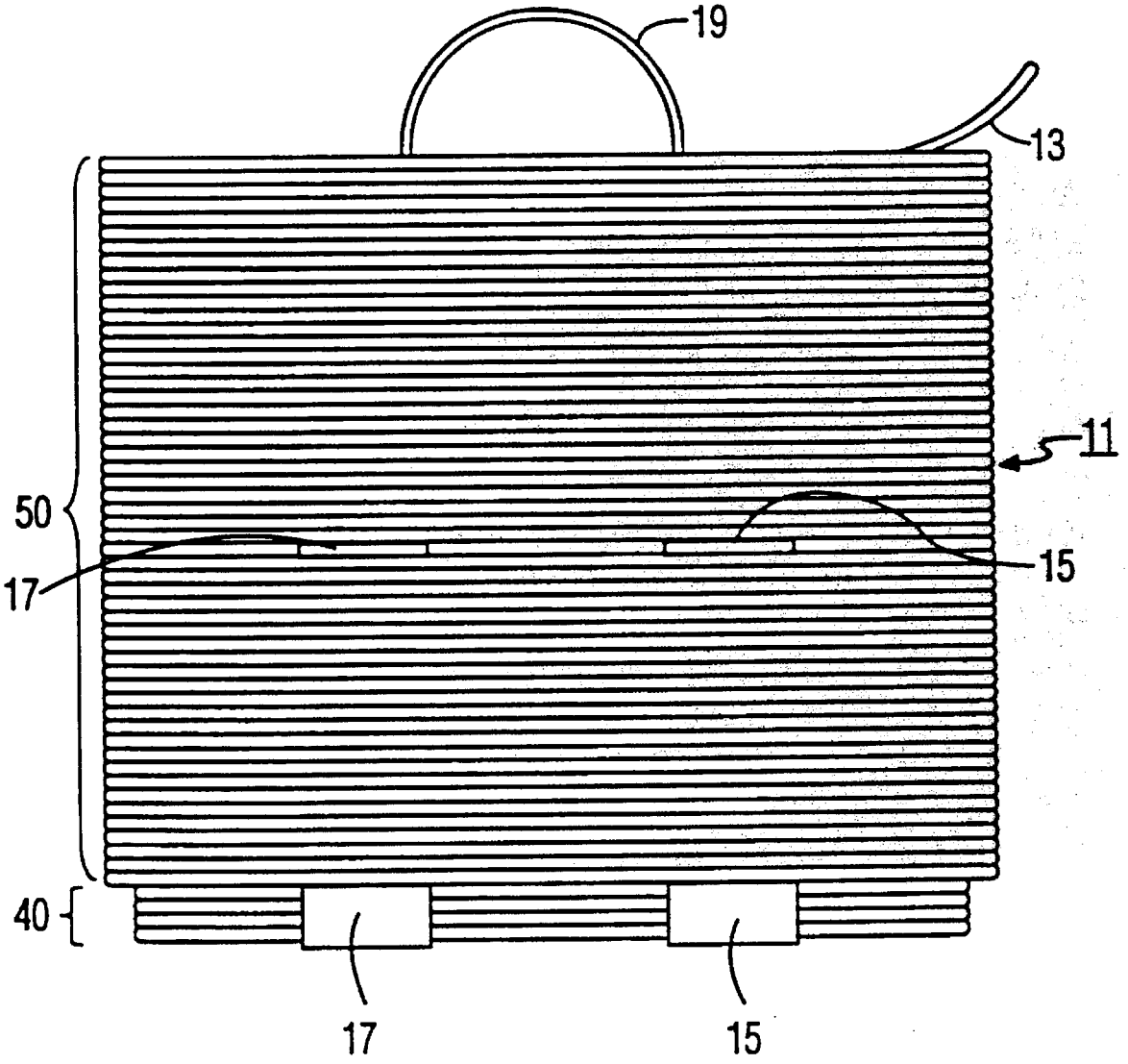
FIG. 3 shows the coil of FIGS. 1 and 2 at a third interim stage, subsequent to the second stage of manufacture.

Strip 17 is now temporarily lifted from contact with layer 40 until the tapped turn has been wound thereunder. Strip 17 is then repositioned to once again be in contact with layer 40. Additional turns of layer 50 are now wound. FIG. 3 illustrates an almost fully wound layer 50. Winding of turns to form a fully wound layer 50 cover and thereby secure a second portion of each of strip to coil 11. More particularly, the second portions of each strip are secured between layers 40 and 50.

In winding each of the layers, grooves are formed between adjacent turns. The turns of each layer but the first layer, which is in contact with the bobbin, nest into the grooves of the underlying layer in forming a precision wound coil 11.

Figure 4:
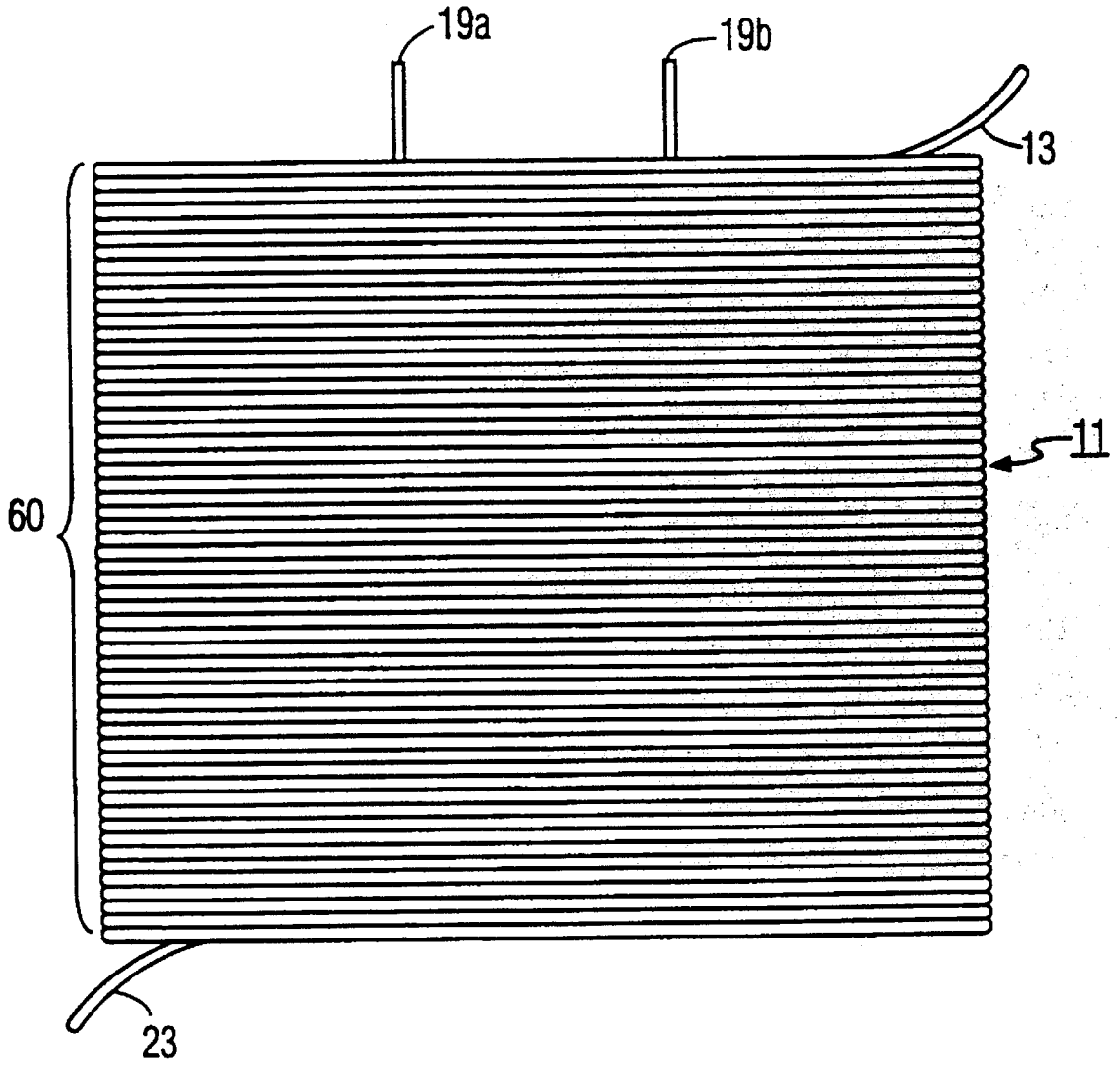
FIG. 4 shows an electrical coil being made in accordance with the invention at a final stage of manufacture.

In finishing coil 11, one or more additional layers 60 are wound as shown in FIG. 4. The finished coil includes a wire 23 brought out at the bottom of coil 11. Loop 19 is out so as to form a pair of leads (taps) 19*a* and 19*b*.

As will be appreciated by those skilled in the art a precision wound coil is produced in which the turns of an upper layer nest in the turns of the layer below it notwithstanding a particular turn has been brought out for purposes of connection in a suitable circuit. Loop 19 is sufficiently thin to not interfere with the precision winding of the coil. As those skilled in the art will also understand the invention is not limited to bringing out one turn of a precision wound coil. Various other turns could also be brought out from any layer and any section in the width of the coil by practicing the method disclosed herein.

Leads 19*a* and 19*b* are securely positioned between layers 40 and 60. Lateral movement to the left or right as shown in FIG. 2 is prevented by tapes 17 and 15, respectively. As can be readily appreciated, tapes 15 and 17 serve as markers/guides to identify the position at which leads 19*a* and 19*b* should be formed. Tapes 15 and 17 also serve as anchors to maintain leads 19*a* and 19*b* in a relatively stationary position relative to the precision wound matrix pattern and to maintain the overall precision wound matrix pattern in a predetermined configuration.

It should be apparent that various modifications of the above will be evident to those skilled in the art and that the arrangement described herein is for illustrative purposes and is not to be considered restrictive.

What is claimed is:

1. A precision-wound coil comprising:

a. a multiplicity of turns of wire wound in a plurality of adjacent layers including an inner layer disposed between first and second layers, said second layer including a predetermined one of said turns which is disposed intermediate other turns of said second layer and including an outer circumferential surface that is remote from said inner layer;

b. anchor means comprising at least one strip of material extending transversely of said turns and including first and second portions connected by an intermediate portion disposed between the first and second portions, the first portion being disposed between the first layer and the inner layer, the second portion being disposed between the second layer and the inner layer, and the intermediate portion extending partially around the circumference of the predetermined one of the turns in the second layer and along said outer circumferential surface; and c. tapping means comprising a continuation of the wire forming said predetermined one of the turns, said continuation extending from said anchor means, between adjacent ones of the layers, and transversely across the turns of said adjacent layers to a location external of the coil turns.

2. A precision-wound coil as in claim 1 where the anchor means comprises spaced-apart first and second ones of said at least one strip of material.

3. A precision-wound coil as in claim 2 where the tapping means comprises a continuous length of the wire forming said predetermined one of the turns, said continuous length extending from the first and second strips and transversely of the turns of wire, between adjacent layers, and forming a loop external of the turns.

4. A precision-wound coil as in claim 2 where the tapping means comprises a cut length of the wire forming said predetermined one of the turns, said cut length extending from the first and second strips and transversely of the turns of wire, between adjacent layers, and forming first and second leads external of the turns.

5. A precision-wound coil as in claim 1 where the anchor means comprises a strip of adhesively-backed insulating material.

* * * * *